US007618208B2

(12) United States Patent
Baines et al.

(10) Patent No.: US 7,618,208 B2
(45) Date of Patent: Nov. 17, 2009

(54) ATTACHMENT MEANS FOR A COSMETIC DISPENSER

(75) Inventors: Roger Anthony Baines, Seacroft (GB); Paul Haigh, Seacroft (GB); Paul Nicholas Pay, Seacroft (GB); Mark Geoffrey Somers, Seacroft (GB); Reginaldo Alexandre Tavares Da Silva, Seacroft (GB)

(73) Assignee: Conopco, Inc., Englewood Cliffs, NJ (US)

( * ) Notice: Subject to any disclaimer, the term of this patent is extended or adjusted under 35 U.S.C. 154(b) by 633 days.

(21) Appl. No.: 11/184,408

(22) Filed: Jul. 19, 2005

(65) Prior Publication Data

US 2006/0029455 A1 Feb. 9, 2006

(30) Foreign Application Priority Data

Jul. 20, 2004 (GB) ..... 0416248.3

(51) Int. Cl.
*B43K 23/08* (2006.01)

(52) U.S. Cl. ..... 401/213

(58) Field of Classification Search ..... 401/213, 401/214, 216, 219; 215/217, 222, 223
See application file for complete search history.

(56) References Cited

U.S. PATENT DOCUMENTS 2,858,558 A 11/1958 Sudbeaz ..... 15/132.7
2,968,826 A 1/1961 Leshin ..... 15/132.7
2,981,968 A * 5/1961 Schaich ..... 401/213

(Continued)

FOREIGN PATENT DOCUMENTS

DE 198 27 965 12/1999

(Continued)

OTHER PUBLICATIONS

GB Search Report in a GB application GB 0416248.3.

(Continued)

*Primary Examiner*—Huyen Le
(74) *Attorney, Agent, or Firm*—Karen E. Klumas

(57) ABSTRACT

Conventional dispensers for a cosmetic fluid, such as a liquid, comprises a bottle having a housing for a low regulator, such as a roller or preferably a ball and a cap which is securable to the bottle by a single set of co-operating screw threads. An improved dispenser secures the cap to the bottle, and especially to the housing, by a plurality of sets of mounting elements, one of which comprises a cam providing axial movement of the cap when it is rotated around the bottle and the other a follower, such a lug and bayonet. One element is mounted on the interior of the cap and the other on the exterior of the bottle/housing. The mounting elements on the bottle/housing advantageously are separated both laterally around the periphery and axially so as to permit the mounting elements on the cap to pass axially between adjacent bottle elements and the cap to be rotated until matched sets of elements are brought into contact. The bottle can comprise separate moldings for the housing and the reservoir which are in fluid tight fitting, the moldings preferably having anti-rotational means such as an axial-extending lug on one molding that can be slid into an axial slot channel or socket on the other molding.

29 Claims, 10 Drawing Sheets

U.S. PATENT DOCUMENTS

| | | | | |
|---|---|---|---|---|
| 3,069,718 | A | 12/1962 | Brady et al. | 15/571 |
| 3,075,230 | A | 1/1963 | Marchant | 15/571 |
| 3,111,703 | A | 11/1963 | Kaufman | 15/572 |
| 3,216,600 | A * | 11/1965 | Dreps | 215/230 |
| 3,284,839 | A | 11/1966 | Cook | 15/541 |
| 4,059,198 | A | 11/1977 | Mumford | 215/222 |
| 4,221,495 | A * | 9/1980 | Braun et al. | 401/213 |
| 4,223,795 | A | 9/1980 | Akers | 215/222 |
| 4,434,903 | A | 3/1984 | Cooke | 215/222 |
| 5,213,431 | A | 5/1993 | Gentile et al. | 401/219 |
| 5,449,078 | A * | 9/1995 | Akers | 215/222 |
| 6,155,736 | A | 12/2000 | Evans et al. | 401/219 |
| 6,179,505 | B1 | 1/2001 | Oder, III et al. | 401/213 |
| 6,511,243 | B2 | 1/2003 | Miranda | 401/213 |
| 6,547,471 | B1 * | 4/2003 | Tucker et al. | 401/206 |
| 2003/0080198 | A1 | 5/2003 | Garcia et al. | 239/44 |
| 2008/0121751 | A1 | 5/2008 | Steinhagen et al. | 242/588.6 |

FOREIGN PATENT DOCUMENTS

| | | |
|---|---|---|
| DE | 299 14 452 | 1/2000 |
| DE | 201 19 329 | 4/2002 |
| DE | 102 11 483 | 9/2003 |
| GB | 740220 | 11/1955 |
| GB | 1115861 | 5/1968 |
| GB | 1 515 078 | 6/1978 |
| GB | 2 255 052 | 10/1992 |
| GB | 2 268 912 | 1/1994 |
| GB | 2 272 186 | 5/1994 |
| GB | 2 275 024 | 8/1994 |
| GB | 2 374 045 | 10/2002 |
| WO | 00/49908 | 8/2000 |
| WO | 00/64302 | 11/2000 |
| WO | 02/051283 | 7/2002 |
| WO | 2005/079621 | 9/2005 |

OTHER PUBLICATIONS

Derwent Abstract of DE 201 19 329—published Feb. 28, 2002.
Derwent Abstract of DE 102 11 483—published Sep. 23, 2003.
GB Search Report in a GB application GB 0416251.7.
Co-pending application: Applicant: Tavares da Silva; U.S. Appl. No. 11/184,489, filed Jul. 19, 2005.
Co-pending application: Applicant: Baines et al., U.S. Appl. No. 11/184,571, filed Jul. 19, 2005.

* cited by examiner

ATTACHMENT MEANS FOR A COSMETIC DISPENSER

The present invention relates to attachment means for a cosmetic dispenser, and especially to improvements in a dispenser of a fluid.

TECHNICAL FIELD

Herein the term fluid indicates a material other than a gas which is capable of flowing without retaining its physical shape and accordingly excludes firm solids which retain their shape when subjected to mild pressure. The term includes liquids or creams which may be aqueous or anhydrous and flowable particulate solids. In particular, the present invention is directed to dispensers of a liquid of low or intermediate viscosity.

Fluids are employed widely for many home and personal care applications, such as for the dispensing of washing formulations, washing or rinsing additives such as bleaches and fabric conditioners, surface cleansers and/or disinfectants including toilet cleansers, and cosmetics, toiletries or medicaments for the topical application of an active substance to the human or animal body. Dispensers for cosmetic fluids commonly comprise a bottle having an opening through which the contents of the dispenser flow out under gravity or under mild pressure exerted by grasping the dispenser or are conveyed out by a flow regulator. One commonly employed class of dispenser is often called a roll-on. In a roll-on dispenser, a housing defines the opening within which a rotatable ball or roller is seated, dimensioned such that in operation there is a narrow passage between the ball or roller and its housing connecting the interior of the dispenser bottle with its exterior. However, other and related classes of cosmetic fluid dispensers can be contemplated employing other or related flow regulators.

BACKGROUND AND PRIOR ART

Roll-on dispensers are very popular for dispensing liquids and to a more limited extent for dispensing powders since the ball or roller acts as an efficient way of distributing the contents of the dispenser over skin or other application surfaces. However, the dispenser has one potential disadvantage. If the closure of the dispenser is not applied properly and tightly, there is a risk of the contents leaking out of the dispenser if it has fallen on its side or if it is a so-called invert dispenser, by which is meant herein a dispenser in which the opening of the dispenser under its normal storage orientation is at the bottom of the dispenser or if an upright dispenser is stored in an invert orientation in order to ensure that its contents is employed to the last drop. It will be recognised that if the closure is not fluid tight, then the fluid contents can flow out. This is both wasteful and potentially messy.

Commonly, the closure for roll-on dispensers comprises a cap which fits over and around the housing for the ball or roller. The cap advantageously has a side-wall so dimensioned and/or an interior wall extending centrally from its closed end which engages the ball or roller and urges the latter towards the interior surface of the housing, closing the gap between the two of them and effecting a fluid-tight fit. This entails moving the cap towards the dispenser, axially, during the securing operation (and herein this is sometimes called downwards) and commonly for roll-on dispensers this is achieved by co-operating screw threads on respectively the interior face of the cap and the exterior face of the housing or bottle. In order to be effective, at least once complete turn of the screw threads around the housing or bottle and the cap is needed, otherwise the cap when fitted does not apply balanced axial forces around the perimeter of the ball, and rocking of the cap on the housing is possible, so that there is a significant risk of leakage from the dispenser. However, if greater than a single turn of screw threads is employed, that too introduces potential difficulties. Most humans are unable to rotate a cap for a complete turn around a dispenser housing, or if they can do so, the rotational force at or approaching the 360 degree point is very weak, whereas it is at that time in the procedure for fitting the cap when the greatest force is needed to tighten the screw. This means that the cap must be released from the hand, the cap hand reoriented relative to the cap, and the rotated further. The dispenser bottle/housing could alternatively be rotated relative to the cap, but the problem is the same. Many humans are rather lazy or in today's world are rushing to save time for activities perceived to be more important than securing a cap onto a bottle. Accordingly, there remains a risk that the consumer will fail to rotate the cap adequately if the cap employs a screw thread. Furthermore, the reverse problem can also arise with screw threaded closures, namely over-threading, because the leading edge of a thread is normally chamfered so as to assist in seating of the thread into its groove. Over-rotation can cause distortion of the cap and with a consequential immediate risk of incomplete closure or of the cap not being properly secured in a subsequent closure.

Roll-on dispensers employing a screw-thread connection between cap and bottle are described in for example in GB 2272186, GB2275024, U.S. Pat. No. 2,968,826, U.S. Pat. No. 6,511,243, WO 00/49908 and WO 00/64302. Such dispensers are commonly available commercially in 2003, ranging from world-wide brands such as Rexona™, Dove™ and Axe™ through to brands available regionally or locally such as own label brands in supermarkets. Dispensers intended for storage in an invert orientation are described in the above-mentioned U.S. Pat. No. 6,511,243 and are commercially available under the brand Avon. However, many existing commercially available roll-on dispensers in June 2004 have been capable of standing in both an upright and invert orientation, such as those under the above-mentioned global brands and Amplex™. All of these employed a screw thread to attach the cap to the dispenser body.

Screw threads are not the only means previously contemplated for attaching a cap to a bottle or jar. An alternative system comprises a so-called bayonet system which employs a plurality of sets of engagement means, each set comprising a bayonet that is rotated into a locking recess in a mating lug. Such a system is described in each of U.S. Pat. No. 4,434,903, U.S. Pat. No. 4,223,795 and U.S. Pat. No. 4,059,198, amongst others, for attaching a cap to upright bottles, sometimes in combination with or in the context of child resistant closures. The bayonet systems disclosed in said patent specifications commonly mount each set of bayonet/lug symmetrically and at the same axial spacing from the respective mouths of the cap and bottle. They can be described as simple multi-start systems. Such an arrangement of bayonets and lugs means that any bayonet can be mated with any lug, which is acceptable if the cap is symmetrical. However, if the cap and bottle exhibit a degree of asymmetry, for example from their shape, pattern, configuration or adornment, such simple symmetry creates the risk of a user replacing the cap in an incorrect orientation.

Although the problem of obtaining a fluid seal preventing egress of liquid by rotation of the cap relative to bottle has been described in the context of a roll-on dispenser, it will be recognised that a similar seal is needed if an alternative flow regulator were to be employed.

A further possible complication is that designers of cosmetic dispensers are seeking ways to differentiate their containers from those of competitors. This assists in product recognition and assists the customer to select the same product again if he or she has been satisfied by its performance. One way of achieving packaging distinctiveness is by creating a less symmetrical shape for the dispenser and a corresponding shape for the cap. In order to preserve the integrity of such a design, the cap needs to fit on the dispenser in a unique orientation.

Accordingly, it would be desirable to devise a means of securing a cap onto a dispenser for a hand-held cosmetic fluid which avoided one or more of the risks or disadvantages associated with a conventional screw thread mounting means but at the same time ensured a desired orientation of the cap relative to the bottle of dispenser.

SUMMARY OF THE INVENTION

According to the first aspect of the present invention there is provided a cosmetic dispenser for a fluid in accordance with claim 1 hereinafter.

Herein the terms inward and outward when employed axially as in inward end and outward end in respect of a housing intended for mounting on or integral mounding with a bottle reservoir refer respectively to the end adjacent to and the end remote from the reservoir. Axial relates to an axis extending centrally through the inward and outward ends of the housing. Herein, the terms upward, downward, above and below when employed in respect of the dispenser and its constituent parts refer to when the dispenser is in an upright orientation, which is to say the cap is above the bottle.

The dispenser of the present invention comprises a bottle having an outlet defined by a housing for a flow regulator, commonly a roller or ball, by which is meant herein a chamber dimensioned to receive the flow regulator, having a side wall shaped to define an upper and a lower aperture each of narrower diameter than the flow regulator, thereby retaining the flow regulator in its chamber. Particularly suitable flow regulators comprise a roller or ball, the housing allowing the roller or ball to protrude both within the interior and into the exterior of the bottle and provide with the housing a passageway for fluid to flow or be conveyed from within the bottle reservoir onto a surface which comes into contact with the roller or ball.

Advantageously, by providing a multi-start system for mounting the cap on the bottle for a cosmetic fluid dispenser as defined in claim 1, it is possible to reduce the risk of consumers failing to close the dispenser properly after use. Simultaneously, the invention mounting system releases designers of cosmetic fluid dispensers from the constraints of simple designs such as plain cylindrical designs, by ensuring that even asymmetric designs can enjoy proper alignment of cap and bottle to retain the desired design every time. The invention mounting system is able to achieve its objectives by forming matched pairs of mounting elements. By matched pairs is meant that the co-operating elements are located at the appropriate axial distance relative to the mouth of the cap and first end of the bottle respectively such that when the cap is presented over the housing and is rotated around the first, open end of the bottle, the two elements come into contact.

In the invention mounting system, the individual mounting elements on the bottle are spaced apart around the periphery of the bottle, the distance between them being enough to form passageways between adjacent mounting elements through which the mounting elements on the cap can pass axially, but additionally, the invention mounting system spaces the bottle mounting elements axially, so that when the cap is rotated, a non-matched cap mounting element can pass above or below a non-matched bottle mounting element or between adjacent pairs of non-matched bottle mounting elements until it encounters a matching element. Naturally, in order to attain matching, the mounting elements on the cap are correspondingly located relative to its mouth as the bottle mounting elements are relative to the first end of the bottle.

It will be recognised that a simple multi-start system is unable to provide such a benefit because it does not space the sets of bayonet and lug axially, so it inevitably carries the risk that the consumer will mis-match the element of one set of mounting with the other element of a different set of elements and thereby destroy the aesthetic integrity of the dispenser.

DETAILED DESCRIPTION OF THE INVENTION AND PREFERRED EMBODIMENTS THEREOF

A central feature of the first aspect of the instant invention relates to the employment of a multi-start system for attaching the cap to the bottle instead of a continuous screw thread. Not only does this offer advantages as described hereinbefore, but it can also assist in reducing the weight of packaging needed to form the bottle and cap, thereby helping to minimise the use of resources on packaging. It is especially beneficial for the component sets of mounting elements of a multi-start system to be axially staggered.

The instant invention is particularly suitable when a ball is employed as the flow controller, and hereinafter the description will often relate expressly to the use of a ball, but a roller or alternative flow regulator can be substituted, mutatis mutandis except where specifically stated.

The bottle and the cap are each preferably made from a thermoplastics material such as polyethylene or polypropylene. Where the flow controller comprises a ball or roller, that is often a hollow thermoplastic, in many instances made by sticking two halves together.

The mounting system herein employs two co-operating elements. One preferred system employs sets of combination of a mounting lug which is preferably mounted on the bottle and a bayonet which preferably is mounted on the cap. Herein after, unless expressly mentioned, the invention will be described for the mounting lugs being mounted on the bottle, but the mounting lug and bayonet can be mounted in the reverse manner, if desired, and such an alternative is incorporated herein, mutatis mutandis. Whilst other methods of mounting the lug and the bayonet on their respective walls may be contemplated, such as by adhesives or mounting in bores or blind bores, it is most convenient in practice for each to be moulded integrally with its wall, for example by injection moulding.

Herein, the terms "leading" and "trailing" or "lagging" in relation to the mounting means and particularly the mounting lug are determined in relation to the rotational closure of the cap, unless the context demands otherwise.

The mounting lug preferably comprises a leading surface that is followed by the follower, i.e. the bayonet during relative rotation of cap and bottle, terminating at its trailing edge in a recess in which the bayonet is retained when the cap is mounted on the bottle. The bayonet-retaining recess, which can alternatively be considered to be a locking recess, is preferably deep enough to render it difficult for the bayonet to slide out inadvertently, which is to say without force applied by the user, but not so deep as to make removing the cap difficult for humans. Desirably, said recess has an axial depth of at least 200 μm and preferably at least 300 μm. Advantageously, the recess is not deeper than 600 μm and in many embodiments not greater than 500 μm. A convenient axial depth of the bayonet for a hand-held cosmetic dispenser is from 1000 to 2000 μm, such as from 1200 to 1600 μm. Expressed in another way, the depth of the recess is commonly in the range of from 15 to 40% of the depth of the bayonet. Preferably, the recess has a contact profile approximately matching the contact profile of the bayonet, and especially desirably, both are rounded. The leading edge of the recess is preferably about a right angle with the cam surface.

At least one mounting lug is advantageously provided with a stop trailing the recess. The stop desirably extends axially downwardly (i.e. away from the bottle first end or towards the cap mouth, as the case may be.) Suitably, the radial profile of the stop can be axial or orthogonal to the leading surface of the mounting lug, or broadly so, for example having a concave face that can come into contact with the bayonet. The stop can be moulded with a lateral guide wall extending laterally below the mounting lug, and especially when the mounting lug is moulded with the bottle in which case it can prevent the bayonet from being forced downwardly excessively. The stop is most conveniently employed in relation to the mounting lug that is furthest from the first end of the bottle when it can be integral with a flange that extends all the way around the periphery of the bottle/housing, the flange possibly also acting as a seat for the mouth of the cap when it is fully fitted.

The leading surface of the mounting lug acts as a cam surface, moving the cap downwardly, i.e. towards the bottle when the cap is rotated to mount it on the bottle. Preferably, the cam surface is inclined at a shallow angle to a plane that is orthogonal to the common axis of the cap and bottle/housing about which the cap is rotated, whether the mounting lug is mounted on the bottle or the cap. The angle of inclination is often from 4 to 25 degrees, in many instances is at least 5 degrees, in some or other embodiments is not more than 10 degrees and 7 to 8 degrees is particularly convenient for the angle. Such a cam system not only can be of assistance in locating the cap on the bottle as well as causing downward axial force to be applied by the cap to seal the dispenser, for example acting upon a roll-on ball. Such force can be applied either by a contact means provided for example by the top wall of the cap itself or by a wall depending from the top wall into the interior of the cap or possibly by arms or ribs extending radially inwards from the side-wall of the cap.

It will be recognised that axial force is applied to seal the dispenser, for example urging the roll-on ball against a sealing annular shelf moulded in the housing interior side-wall when rotation of the cap brings it closer to the second end of the bottle than when first contact is made between the mounting elements. In the context of a roll-ball as flow regulator, its depression by the cap is often less than 2 mm and in many instances is between 0.25 and 1 mm compared with when the cap has been removed. When the cap is fully fitted, it ideally imparts a sealing force of at least 3 kg-f, such as from 4 to 8 kg-f onto the ball, either directly or through the upper wall of the housing. It will be recognised that the mounting combination of bayonet and mounting lug includes a locking recess, the system passes through a point at the trailing end of the cam surface and just at the leading edge of the recess where a greater force is imparted than in the recess itself, sometimes referred to as over-torque. The dispenser bottle/housing, cap and ball together advantageously have limited flexibility to accommodate such brief and limited over-torque.

The bayonet is often spade-like in cross section, having a lower flat surface (i.e. surface remote from the cam), and preferably having a width greater than its depth, such as in the range of from 1.1 to 2.5 times its depth. Although the cam-facing surface could be flat, it preferably has a bevelled or rounded leading or trailing edge, and preferably both, or alternatively is convex. Such chamfering or convex profile assists the two mounting elements to engage smoothly. The bayonet can if desired be strengthened with one or more buttresses, usually extending axially, preferably away from the mouth of the cap or towards the open first end of the bottle as the case may be.

Although the aforementioned combination of mounting lug and bayonet represents a very advantageous mounting system, often because a bayonet in particular subtends only a small arc around the periphery of the cap or bottle, thereby making it comparatively easy for that bayonet to pass axially between adjacent mounting lugs, and/or because this enables a comparatively large number of sets of elements to be employed and/or because also it is relatively easy to provide a trailing stop means to prevent or at least render it very difficult for the cap to over-rotate, one alternative mounting system that can be contemplated, employs a co-operating screw thread for each of the cam and follower. The screw thread arcs for the cam and follower are both preferably approximately the same. When co-operating screw threads are employed, in each set, each screw thread subtends only a short arc, given by the formula $a<360/2s$ where a is the arc in degrees and s is the number of sets, and, preferably, $360/4s<a<360/2.5s$.

The invention employs a plurality of sets of mounting elements and preferably at least 3 sets are employed. The total number that it is convenient to employ depends on the size of the dispenser and the arc which each mounting element subtends. Preferably, there is sufficient circumferential spacing between adjacent elements on the bottle to enable the element on the cap to pass between them with a margin for error on either side, for example the element on the cap occupying no more than about three-quarters and preferably no more than about half the arc between adjacent bottle mountings.

For comparatively large cosmetics dispensers, that is to say dispensers having a capacity of at least 300 mls, maybe as many as up to 8 to 12 sets could be contemplated. However, for smaller hand-held bottles, such as from 15 to 120 mls, as commonly contemplated for dispensing antiperspirant or deodorants, either 3 or 4 sets are desirable, 3 being particularly preferred. Cosmetic dispensers herein in particular comprise rotatable balls in the housing having a diameter of from about 20 to about 40 mm and especially from about 25 to about 36 mm. Representative ball diameters are 25, 29, 32 or 35.5 mm, or thereabouts.

It is preferable if the sets are positioned symmetrically around the circumference of the cap and bottle. By so doing, it maximises the ease of positioning the elements for axially moving the cap to where it can be rotated. Secondly, where the cap imparts a sealing force, a symmetrical arrangement of sets makes it easiest to achieve an even force around the perimeter and thereby minimise the risk of an imperfect seal. When only 2 sets are employed, it is particularly preferable that they are diametrically opposed.

In this first aspect of the present invention, the mounting elements in different matching sets are located at different axial distances from respectively the mouth of the cap and the first end of the bottle. Since the cap is rotated to mount it on the bottle, the respective sets can be regarded as leading and lagging. In some embodiments, the leading mounting set can be considered to be that which is closest to the mouth of the cap and furthest away from the first end of the bottle, and successive sets are preferably further away from the mouth of the cap/closer to the open end of the bottle, for example most conveniently following a helical line. Such a spatial arrangement provides a number of benefits. First, it can enable the cap to be applied with minimal rotation if the user has aligned the bayonet closely leading the leading end of the matched mounting lug, thereby enabling swift and safe closure with a single twist of the hand. However, even if alignment is not so close, the cap can be twisted with very little effort until the mounting lug is contacted. At that point, resistance to rotation increases markedly, signalling to the user to apply effective force. The moulding of the cap and the bottle is under the control of the manufacturer whereas the fitting of the cap to the bottle is carried out by the user, unsupervised. Consequently, the manufacturer, by controlling the location of the various mounting sets around the circumference of the cap and bottle, can ensure that any asymmetric shape, pattern, or ornament that extends between cap and bottle can be accommodated and its integrity maintained every time that the user replaces his cap on his bottle.

When the dispenser comprises a roll-on dispenser employing a ball, the housing for the ball desirably has a flexible upper side wall of diameter defining an outward end that has an interior diameter slightly less than that of the ball, its flexibility permitting the ball to be inserted into the chamber, and the narrower diameter restraining the ball falling out. The chamber generally is approximately a hollow sphere, truncated both above and below the widest diameter of the chamber to retain the ball within the chamber. An annular shelf is preferably formed on the interior face of the chamber, below its widest diameter against which the ball can be urged forming a seal.

In a number of suitable embodiments, a spider can be mounted between the ball and the reservoir, and preferably below the sealing shelf, where one is provided. Herein by the term spider is meant a structure mounted on the interior of the housing having radiating spokes optionally meeting in and/or radiating from a hub and optionally linked by one or more concentric rings. This can alternatively be pictured by some readers as a spider's web. The upward surface of the spider, i.e. that facing the ball may be substantially flat or it may be concave, desirably having a radius of curvature similar to that of the ball, such as described or illustrated in a co-pending application of even date entitled "Improvements in a Cosmetic Dispenser", supplementary contents of which are imported herein by reference.

For employment in a roll-ball dispenser, the cap can additionally comprise on its top wall a centrally located annular wall extending axially towards the mouth of the cap and/or on its inner face a plurality of ribs depending radially inwardly and dimensioned to engage the housing upper side wall or the ball, thereby pressing the wall towards the aforementioned sealing shelf in the chamber wall and further assisting the sealing process. The cap top-wall, if desired, can have a planar exterior or rim, so that if desired, the dispenser can stand stably in an invert orientation. In other embodiments, if desired, the cap topwall can have a convex or conical profile, so as to prevent it standing stably in an invert orientation.

The bottle has a second end opposed to its first end. The second end is closed so as to prevent loss of cosmetic from the bottle. If desired, the second end can have a convex or conical profile, so as to prevent it standing stably in an upright orientation. Preferably, if the bottle second end is so profiled, the cap has a planar exterior surface or rim that permits the bottle dispenser to stand stably in an invert orientation. Alternatively, the second end may provide a planar surface or rim dimensioned to permit the dispenser to stand stably in an upright orientation. Both the cap top wall and the bottle second end may have a planar surface or rim, dimensioned to permit stable standing.

The bottle can comprise a single moulding or, if desired, it can comprise a two part moulding, the housing for the flow controller such as the ball being one moulding and the reservoir for the bottle being the second moulding. Where separate reservoir and housing mouldings are employed, the two mouldings can be friction fitted together and advantageously the housing comprises a dependent skirt or lower side wall fitting around and/or within an aperture defined by a neck section of the side-wall of the reservoir. Most desirably, the skirt and neck have one or more co-operating circumferential beads and grooves to snap-fit the two mouldings together. The housing skirt and reservoir neck preferably each comprise a cylinder, which may or may not be circular in lateral cross section.

Conventionally, when a two part moulding has been employed for the bottle, and the cap attached to the bottle via a screw thread, the bottle thread had been formed on the reservoir. This meant that the cap had to reach over all the housing and over the screw-bearing section of the reservoir as well, so that the cap had to be large and consequently had to consume a lot of packaging material.

Advantageously, in a second aspect of the instant invention, the bottle mountings can be formed on the housing moulding. This means that the cap can be shorter and hence consume less packaging material.

Thus, according a second aspect of the present invention there is provided a cosmetic dispenser as described in claim 26 herein.

In this second aspect, the mounting system preferably comprises matched sets of mounting elements located around the housing perimeter in the manner described hereinbefore in respect of the first aspect of the present invention, except that there is no need for axial spacing between adjacent mountings on the housing, though such axial spatial separation is preferable. Furthermore, the above-mentioned preferences for the mounting system of the first aspect, including numbers or sets of elements, description of particular mounting elements, including lug, bayonet and stop or paired screw threads likewise can apply in respect of the second aspect of the invention, and references to the bottle may be substituted by references to the housing for determining location of its mounting element. In this second aspect, it is not necessary for the sets of mounting elements to be positioned progressively towards the mouth of the cap, though that is an advantageous option. Subsequent descriptions or preferences relating to a separate housing that is mounted on a reservoir apply to both the first and second aspects.

It is highly desirable for the housing has a rigid sidewall in the vicinity of cap mountings provided for example by being thickened or otherwise strengthened to provide the rigidity, thereby eliminating or at least significantly reducing any distortion when the cap is fitted or removed by rotation from the housing.

When the dispenser comprises a non-integral bottle and housing, the two components can conveniently be mounted via mounting means that preferably is different from that employed to mount the cap in the dispenser. Thus, mounting may be axial rather than rotational or if rotational, then of opposite hand. An especially desirably mounting is a snap fit set of co-operating annular beads. In addition, the interface between housing and bottle sidewalls can include one or more annular sealing beads, often a V or narrow delta shaped blade desirably having a flexible tip, which eliminate or at least significantly reduce any leakage when the reservoir is positioned above the housing. Accordingly, such a blade or blades are particularly useful if the dispenser is inverted.

The reservoir and housing mouldings together preferably provide a means preventing relative rotation of the housing and the reservoir around their common axis. Such anti-rotation means suitably can comprise at least one axially extending rib or lug integral with one moulding and at least one co-operating axial slot, channel or socket on the other moulding. The channel, slot or socket can advantageously be formed in the neck side-wall of the reservoir or in the skirt (lower section) of the housing side-wall.

Advantageously, if a slot is employed, it is covered by an overlap of the other moulding. Two combinations of anti-rotation means are especially favoured. In one combination, the neck section comprises at least one slot cut axially down from the top of the neck section and the lower section of the housing side-wall is bifurcated, having an inner wall that slides inside the neck section of the reservoir, an outer wall that slides outside the reservoir neck section, and an annular lateral wall spanning the inner and outer wall that is dimensioned to sit on the top of the reservoir neck section, from which annular wall an axial integral anti-rotation lug extends that fits the slot.

In a second such combination, the neck of the reservoir side-wall adjacent to its mouth is preferably stepped, providing an inward-facing shoulder on which an annular flange formed to the exterior of the housing can sit. A channel (blind slot) can be cut into the reservoir side-wall axially away from the step and an anti-rotation lug is integrally moulded with the flange and to the exterior of the lower side-wall of the housing that extends below the flange. If desired, the side wall can be doubly stepped, for example to assist in accommodating the ingress of housing sidewall bearing a sealing bead.

It is preferable to employ a plurality of ribs or lugs and slots, channels or sockets, and, advantageously, they are arranged symmetrically around the periphery of the housing/bottle so as to ensure an even distribution of forces around the interface between housing and reservoir. The rib/lug and the slot or channel can be tapered, if desired, the leading edge of the sib/lug being narrower than the leading edge of the slot or channel. The leading edges of the rib/lug and/or the slot or channel mouth can be can be rounded or bevelled (chamfered) so as to ease the entry of the rib/lug into the slot or channel.

The presence of such anti-rotation means offers a number of benefits to the fabrication or use of the two-part mouldings. First, these means can assist in providing the correct positioning of the housing on the assembly line when visible to a sensor. Secondly, the anti-rotation means can strengthen the bottle/housing junction, resisting sideways forces that can be exerted by the cap and cause distortion of the housing/bottle during attachment or removal of the cap. If distortion were to occur, it could result in the fluid tight seal being broken and leakage occurring.

It is preferable to employ the same number of anti-rotation means as sets of cap mounting elements. In one convenient arrangement, each anti-rotation means is axially aligned on the housing with a set of cap mounting means. In another alternative, which also has merit, each anti-rotation means is staggered on the housing with a set of cap mounting means.

In order to assist assembly of the dispenser, the housing preferably comprises at least one marker such as a marker blade which can enable a sensor on an assembly device to recognise the orientation of the housing relative to the bottle. The assembly device can rotate the housing about an axis common to the bottle mouth and housing until the sensor detects that the orientation matches a predetermined setting, whereupon the one is axially urged towards the other. The marker can conveniently comprise a skirt on the housing which is hidden by the bottle which subtends an arc, such as from 45 to 120 degrees and especially defines a recognisable shape or profile. The shape or profile is at the discretion of the manufacturer in the light of available technology, and it some instances it can conveniently be a trapezoidal blade. Desirably, such a skirt can extend below the lower side-wall of the housing or below the inner wall of a bifurcated housing side-wall, so that the marker fits inside the reservoir side-wall. Preferably, two markers are employed, one to either side symmetrically of a marker within the bottle, which may suitably be provided by any visible socket on the bottle or a recognisable pattern or marking on the bottle wall.

The system described herein for mounting the cap on the bottle or the housing of a two moulding housing and reservoir in a liquid cosmetic dispenser is well suited to an invert dispenser.

Accordingly, in a third aspect of the present invention there is provided a cosmetic dispenser as described in claim 27 herein.

The choice of a plurality of sets of mounting elements is especially suited to an invert dispenser because it can minimise the extent of rotation of the cap relative to the bottle to fit it securely.

In this third aspect, the mounting system preferably comprises matched sets of mounting elements located around the housing perimeter in the manner described hereinbefore in respect of the first aspect of the present invention, except that there is no need for axial spacing between adjacent mountings on the housing, though such axial spatial is preferable. Furthermore, the above-mentioned preferences for the mounting system of the first aspect, including numbers or sets of elements, description of particular mounting elements, including lug, bayonet and stop or paired screw threads likewise can apply in respect of the second aspect of the invention, and references to the bottle may be substituted by references to the housing for determining location of its mounting element. In this third aspect, it is not necessary for the sets of mounting elements to be positioned progressively towards the mouth of the cap, though that is an advantageous option.

In the third aspect, the bottle can comprise an integral moulding of housing and reservoir as described in relation to the first aspect, or separate mouldings of the housing and reservoir as described hereinbefore with regard to the second aspect, including any preferences expressed therein, except to the extent that such preferences permit deny the dispenser to stand stably in an invert orientation. The description and preferences expressed herein with regard to a bottle formed by mounting a separate housing on a reservoir apply similarly to the third aspect.

Herein, it is especially desirable to employ the cosmetic dispenser according to any aforementioned aspect of the present invention to dispense a liquid. Desirably the liquid has a viscosity within the range of from 500 to 20000 mPa·s, especially at least 1000 mPa·s and more especially at least 1,500 mPa·s. In some very desirable embodiments, its viscosity is below 10,000 mPa·s such as up to 6,000 mPa·s.

Viscosity herein conveniently refers to measurements by a conventional viscometer, such as a Brookfield viscometer at 25° C., RVT, TA, 20 rpm, Hellipath, unless otherwise stated, a stirrer and stirrer speed that are appropriate for the specified viscosity range.

The cosmetic liquid may be a solution, for example an aqueous, or alcoholic solutions (including possibly dihydric or trihydric alcohols, if desired) for example of an astringent antiperspirant active which solutions are well known in deodorant or antiperspirant literature. Alternatively, the liquid can comprise an emulsion which may be an oil in water or a water in oil in emulsion depending on the relative proportions of the phases, their chemical nature and the choice of emulsifiers selected. Once again literature discloses examples of such cosmetic liquids. A further variation comprises a suspension of a fine particulate cosmetic active material in a suitable carrier liquid, which may for example by a water-immiscible liquid such as a volatile silicone and/or other cosmetic oil. The solution, emulsion or suspension may be thickened to any necessary extent by conventional thickeners known for such carrier fluids, including starch or cellulose derivatives, particulate clays, thickening polymers and waxes.

Having described the invention and certain preferred embodiments thereof, specific embodiments will now be described in detail by way of example only, with reference to the accompanying Figures.

Figure 1:
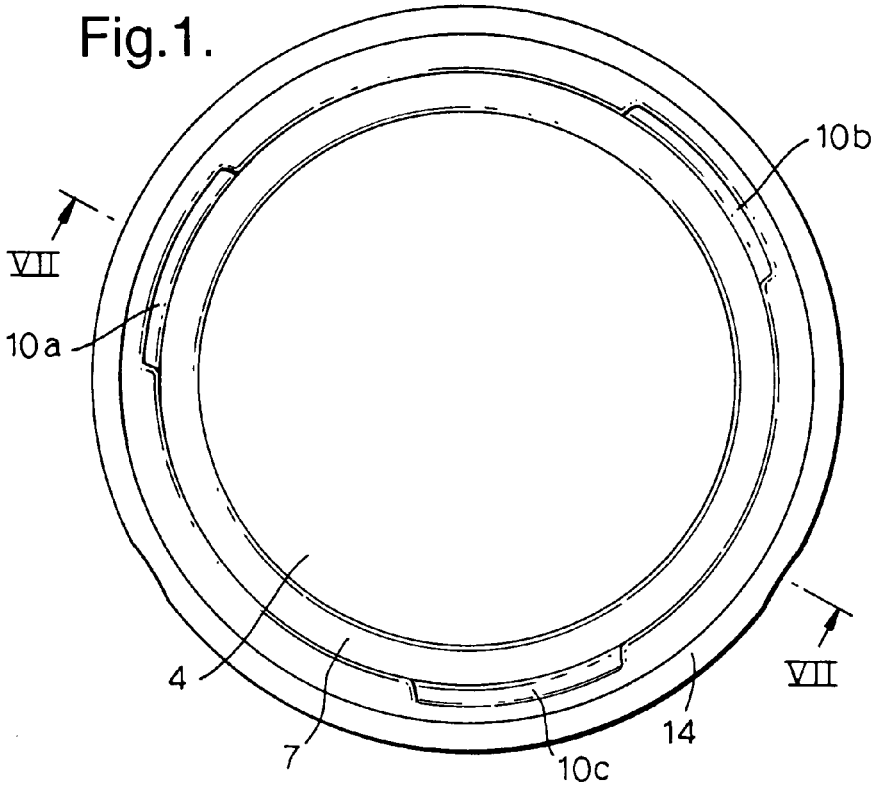
FIG. 1 shows a plan view of a ball housing with ball in place.
Figure 2:
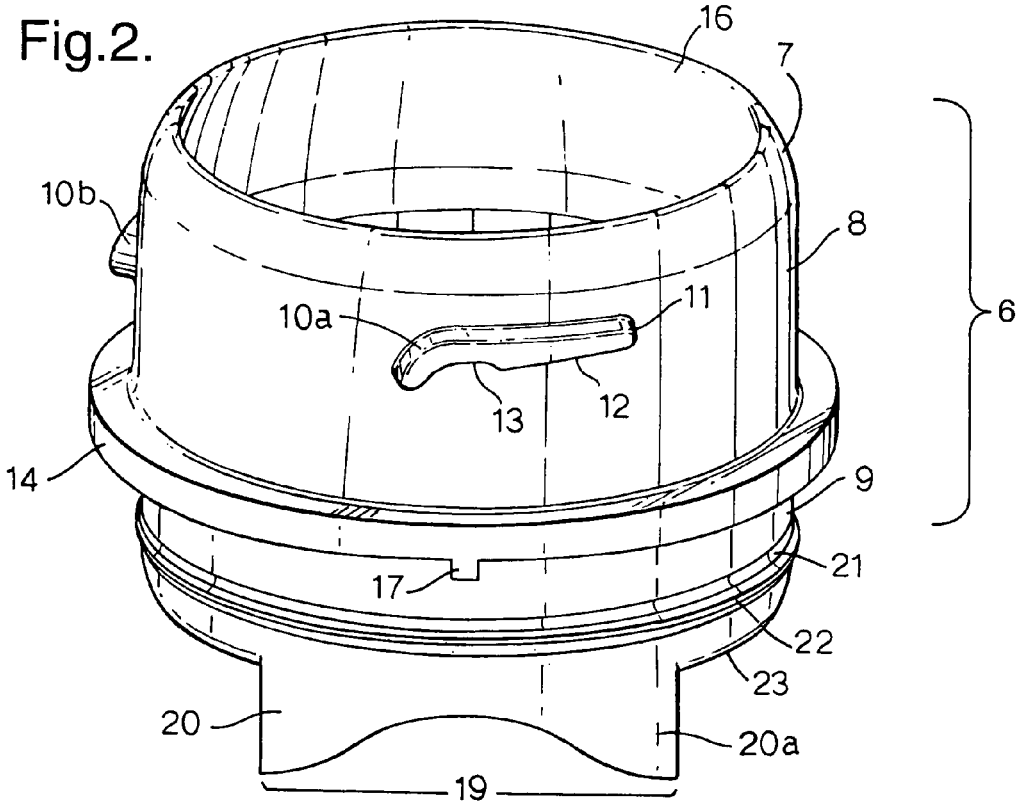
FIG. 2 shows a three-quarter side view of the housing of FIG. 1.
Figure 3:
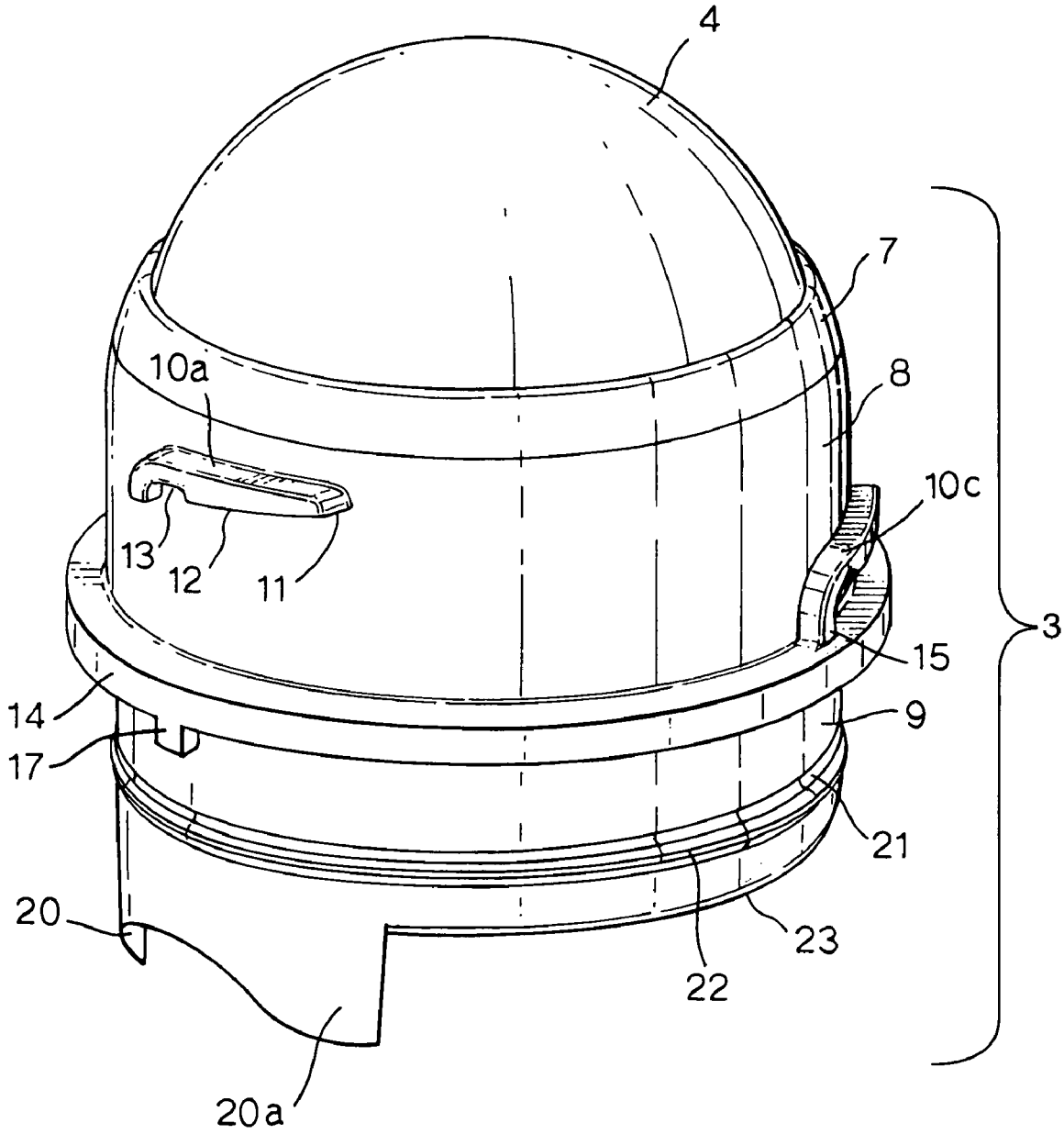
FIG. 3 shows the housing of FIG. 2 rotated through about 60°, with ball in place.
Figure 3A:
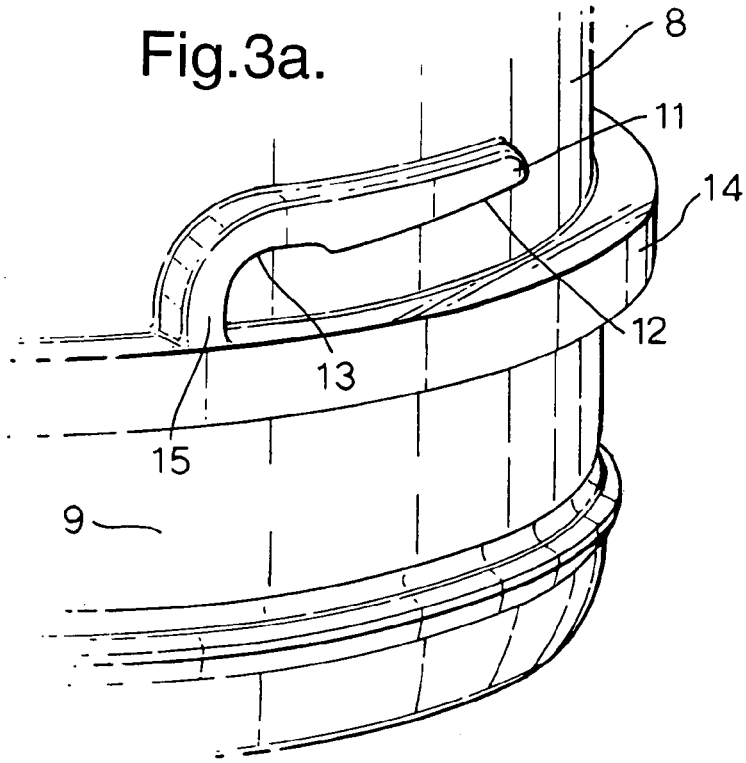
Figure 4A:
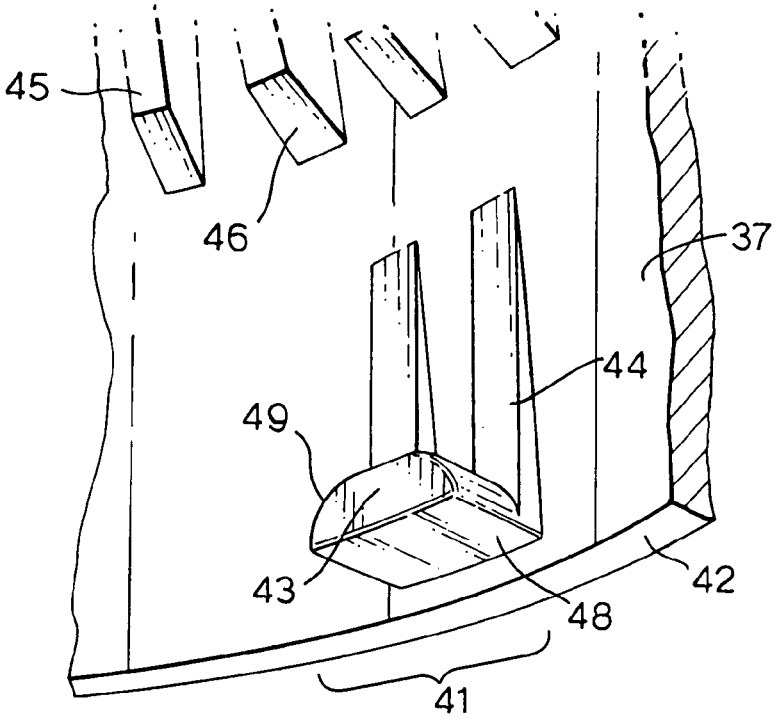
Figure 4:
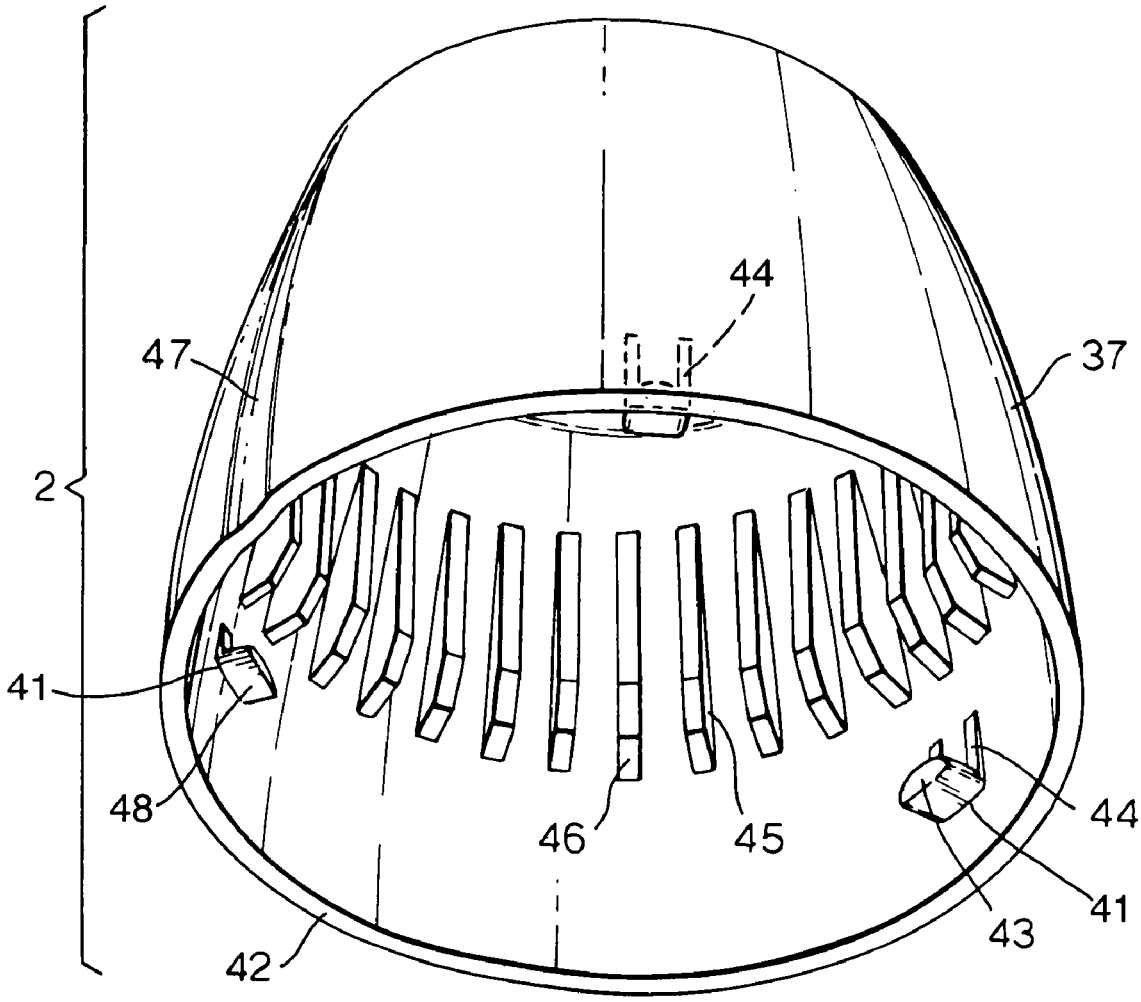
Figure 5:
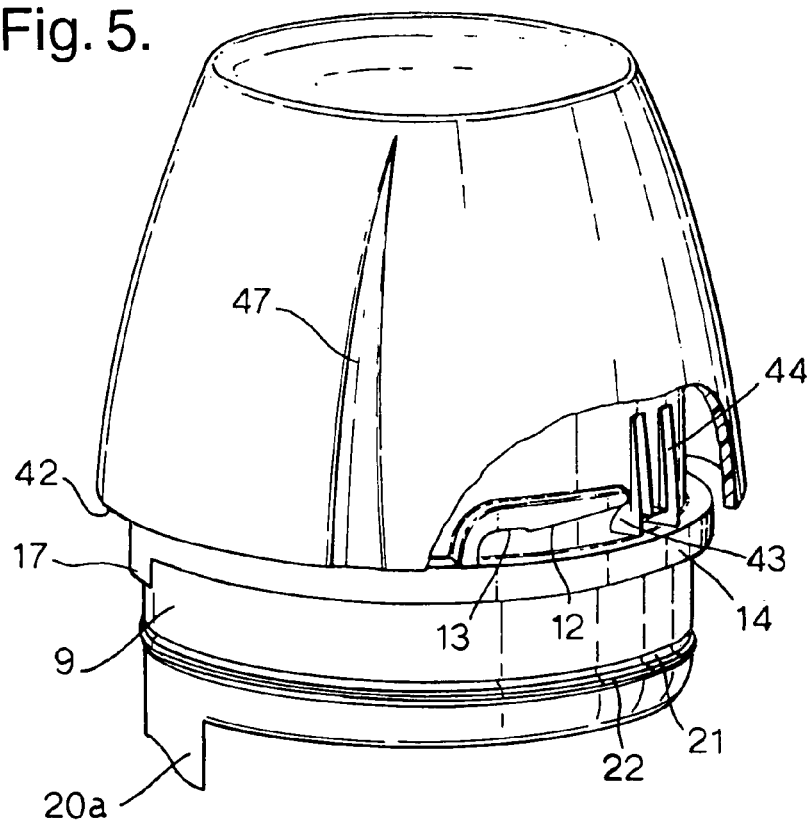
Figure 6:
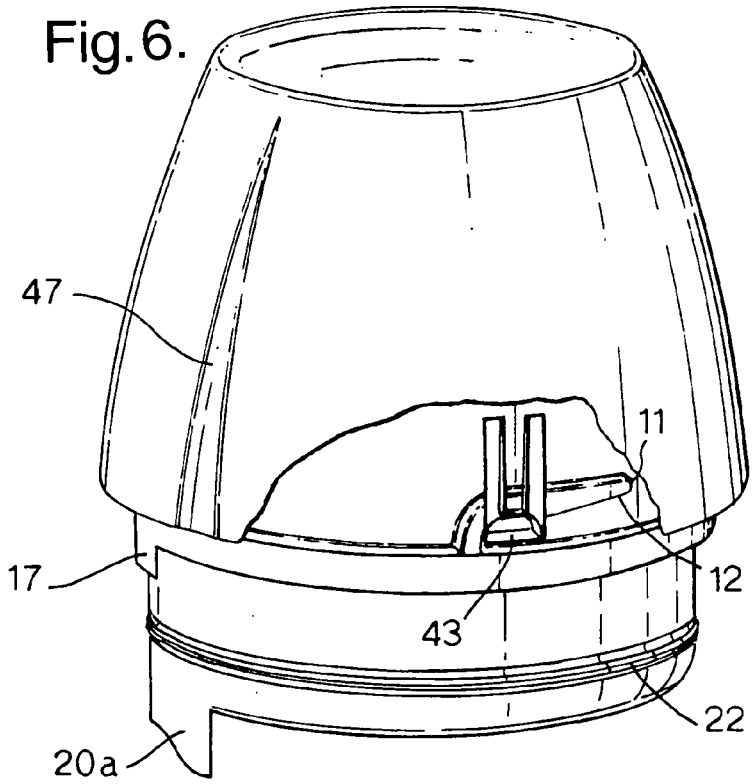
Figure 7:
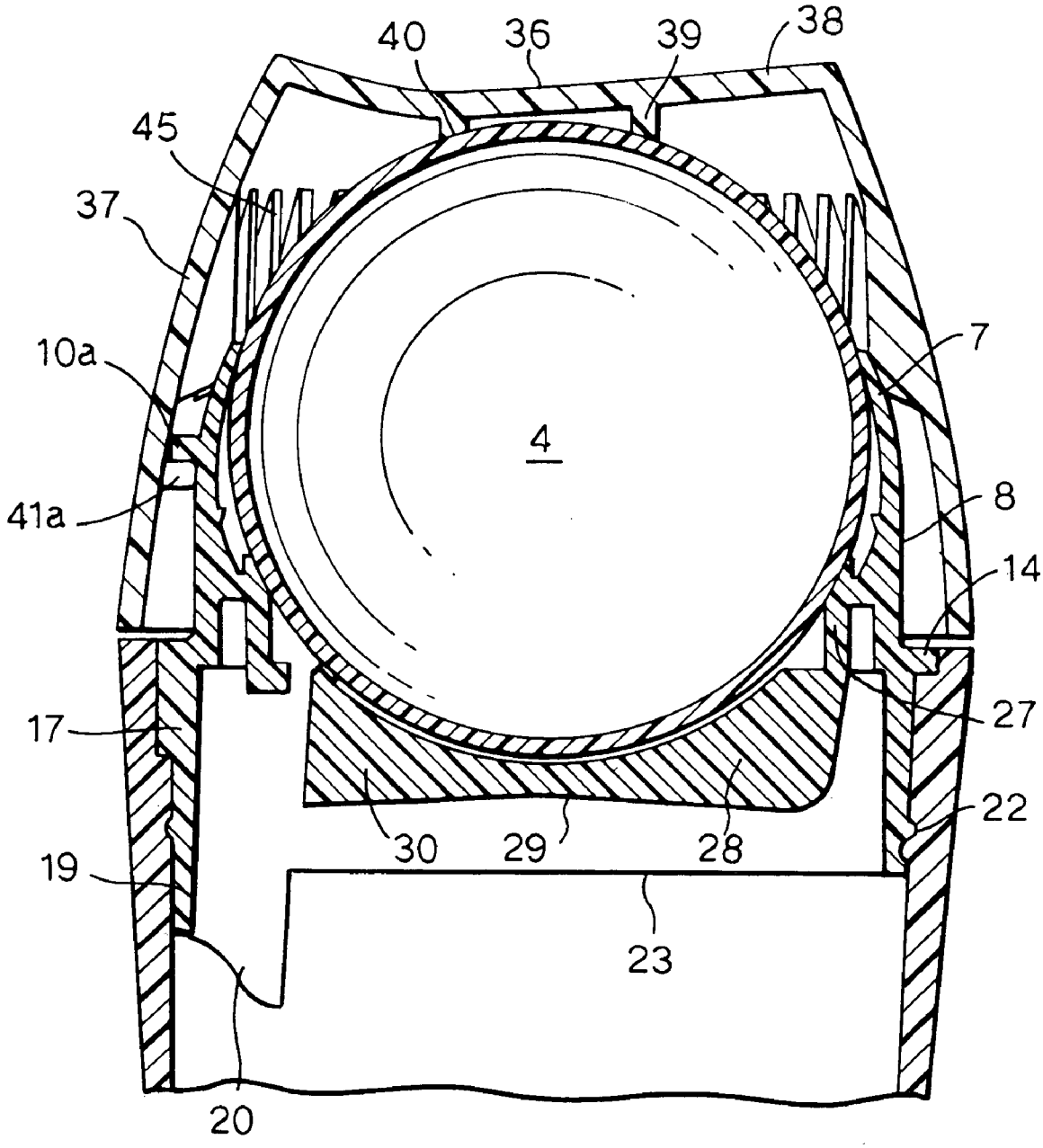
Figure 7A:
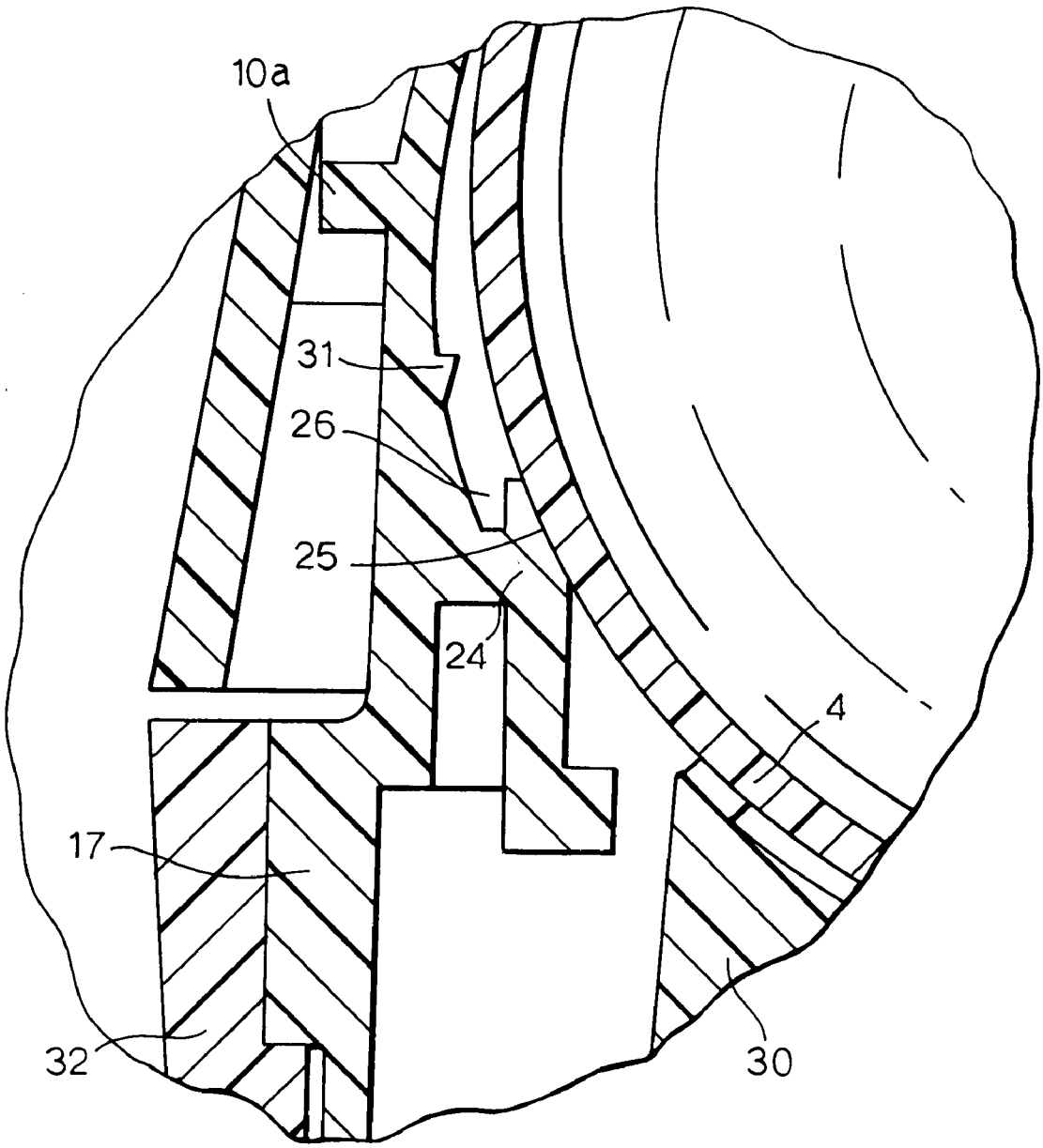

FIG. 3*a* shows an expanded view of the part of the housing of FIG. 3;

FIG. 4 shows a three-quarter view looking into the interior of a cap that fits on the housing of FIGS. 1 to 3;

FIG. 4*a* shows an expanded view of the part of the cap of FIG. 4;

FIG. 5 shows a cut-away view of the cap of FIG. 4 positioned over the housing of FIG. 2 before locking;

FIG. 6 shows the cap and housing of FIG. 7 after locking;

FIG. 7 shows an axial cross section through the locked cap and housing of FIG. 6;

FIG. 7*a* shows an expanded view of part of the cross section of FIG. 7

Figure 8:
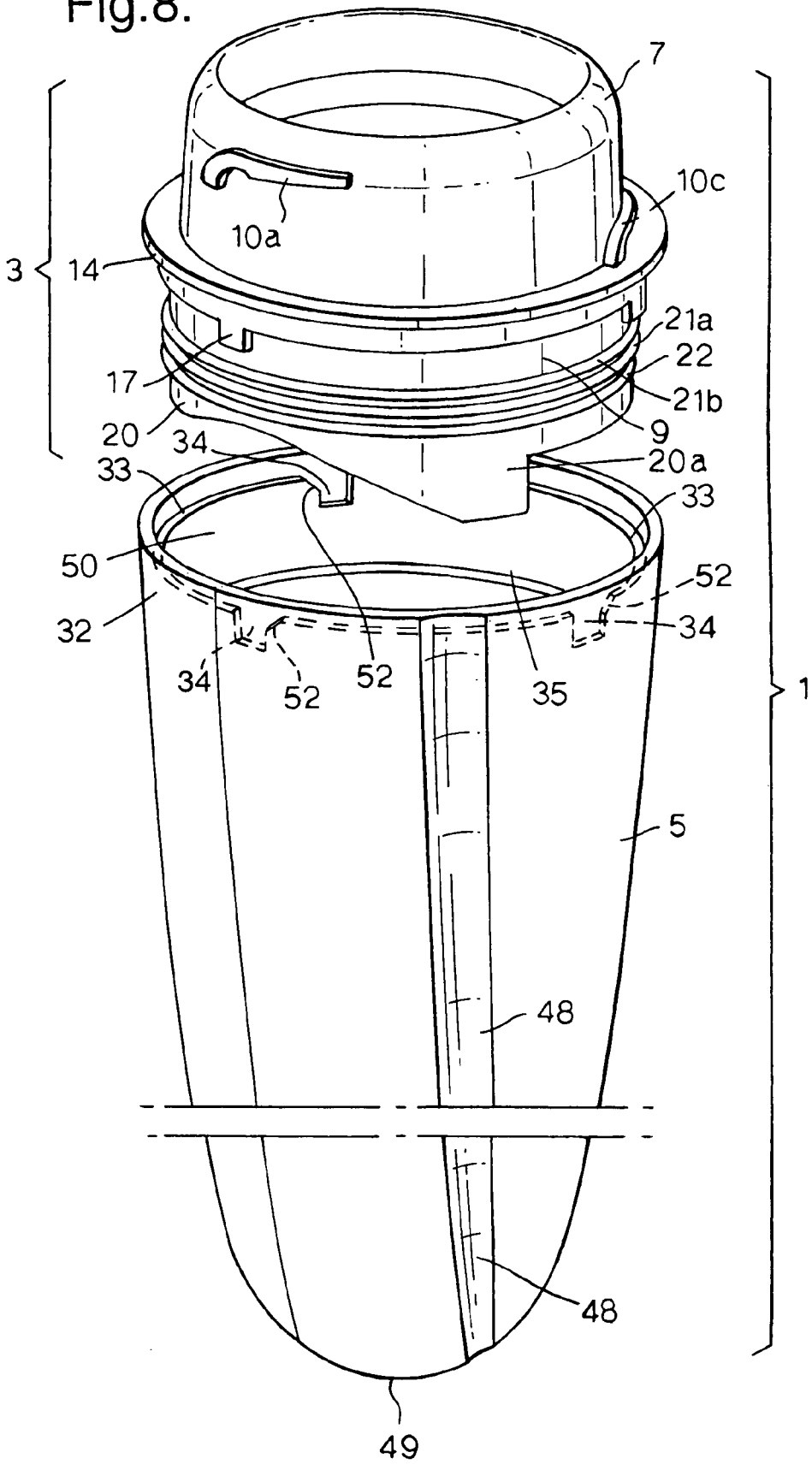

FIG. 8 shows an exploded side view of the bottle and the housing shown in cross section in FIG. 7.

Figure 9:
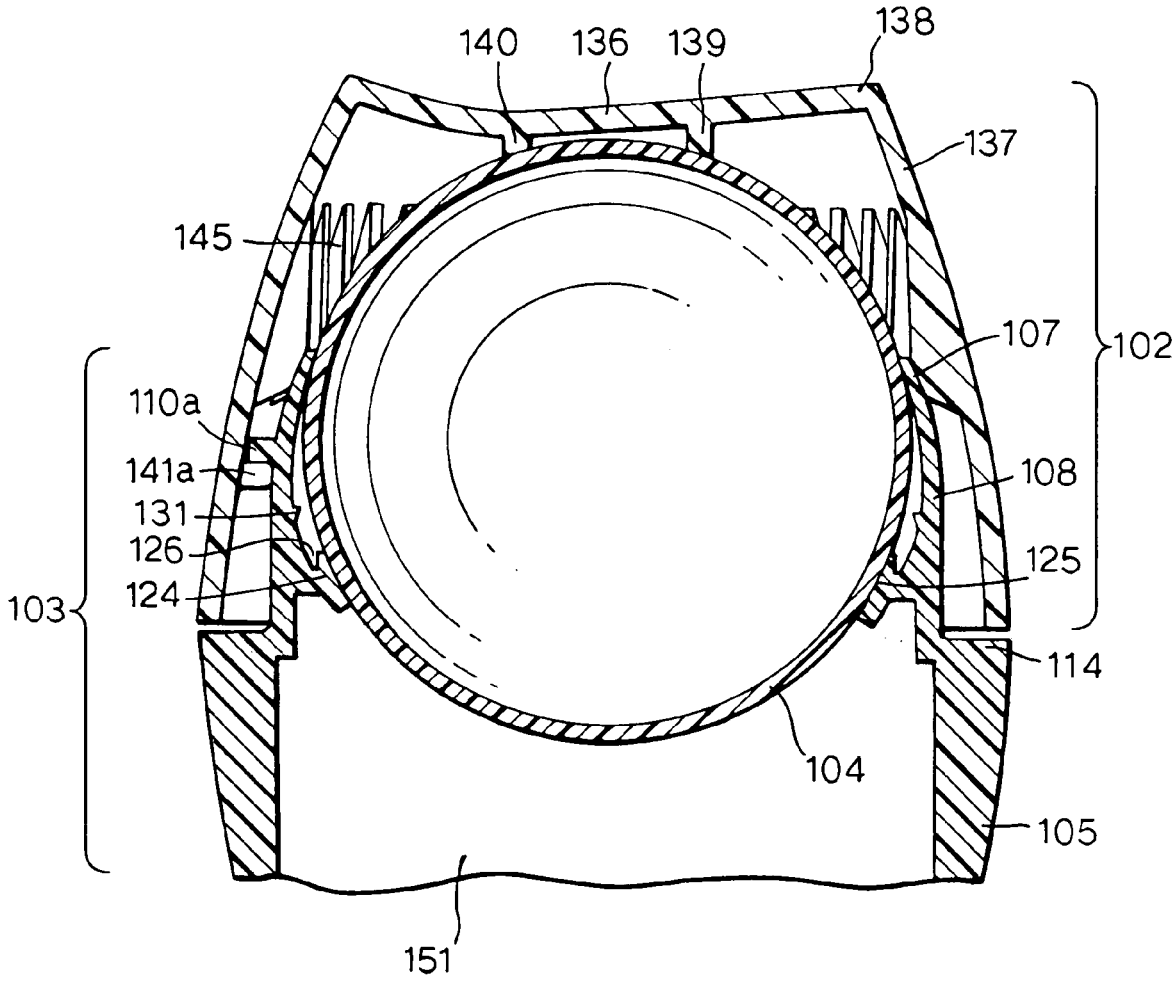
Figure 10:
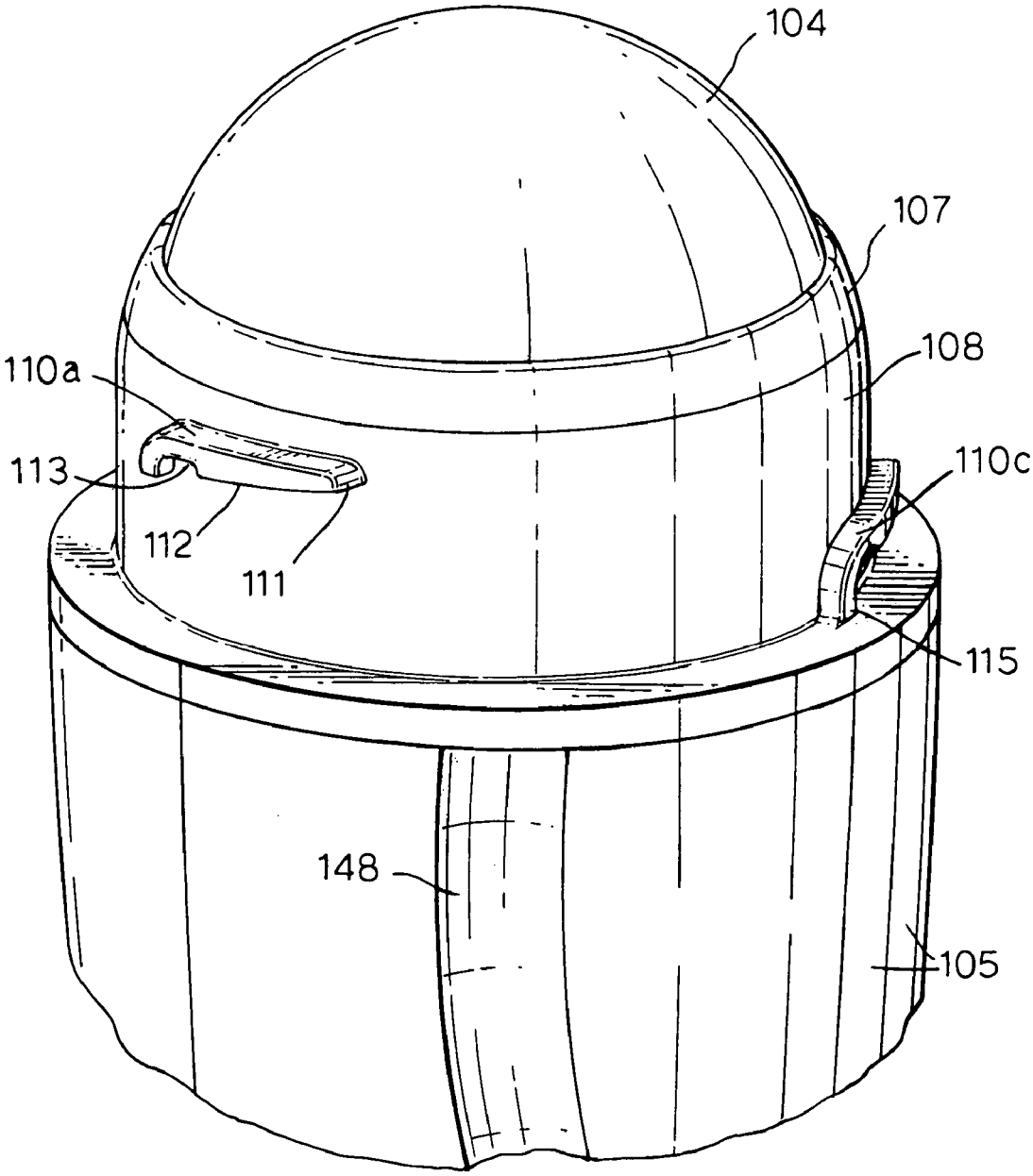

FIG. 9 shows an alternative embodiment in cross section in which the bottle reservoir and housing are integrally moulded, with cap in place and FIG. 10 shows a side view of the embodiment of FIG. 9 with cap removed.

A dispenser according to a first illustrated embodiment of the present invention comprises a bottle (1) and a cap (2), the bottle (1) itself comprising two mouldings adapted to click-fit together, namely a ball housing (3) in which a ball (4) is seated and a reservoir (5).

The ball housing (3) comprises a side-wall (6) comprising an upper wall section (7) of circular transverse cross section, a middle wall section (8) and a lower wall section (9). The upper wall section (7) is an annular concave truncated hemispherical wall which tapers slightly to form a mouth (16) wide enough and the wall sufficiently flexible to permit the ball (4) to be pressed through. Rigid middle wall 8 has a cylindrical exterior on which are integrally moulded three retaining lugs (10*a*, 10*b*, 10*c*) at 120 degrees apart which form three cap-mounting means together with three co-operating bayonets (41*a*, 41*b*, 41*c*) integrally mounted on an interior surface of the side-wall (37) of the cap (2). The retaining lugs (10*a*, 10*b*, 10*c*) are staggered axially, the first mounting lug (10*a*) being closest to mouth (8) and succeeding lugs (10*b*, 10*c*) being progressively further from the mouth (8), such that the cap can be rotated around its common axis with the ball housing (3) until bayonet (41*a*, 41*b*, and 41*c* respectively) encounters the corresponding lug (10*a*, 10*b*, 10*c*). Each retaining lug (10) comprises a rounded leading edge (11), a cam surface (12) directing a co-operating follower, i.e. bayonet (41) away from mouth (16) and a locking recess (13). The third lug (10*c*) is integrally moulded via a trailing axial extension with an exterior circumferential flange (14) providing a stop (15) that prevents continued rotation of the bayonet (41*c*).

An anti-rotation lug (17), in axial alignment with bayonet-retaining recess (10*a*), is integrally moulded with the flange (14) and extends partly down the exterior face of lower wall (9) towards the centre of a locating skirt (19) having two symmetrically mounted trapezoidal blades (20). An annular snap fit bead (22) and two annular leak prevention V shaped blades (21*a*, 21*b*) are formed on the exterior of lower wall (9) intermediate between the flange (14) and inward end (23) of the housing (3).

The interior of the housing (3) is hollow and approximately spherical, truncated at the outward end (16) and inside the middle wall (8), having an upward facing annular shelf (sealing ring) (24) with a concave interior face (25) of similar radius to the ball (4) located below the widest interior diameter of the housing. The sealing ring (24) has an interior diameter sufficiently narrow to prevent passage of the ball (4) into the bottle reservoir (5) and is distanced from the mouth (16) sufficiently to permit the ball (4) to be rotatable unless depressed onto the concave face (25) of shelf (24) by a strong downward force, such as that exerted by the cap (2) when fitted, a force greater than employed when the dispenser is topically applying cosmetic fluid to the human body. The outward edge of the shelf (24) forms with the adjacent side-wall an annular v-shaped groove (26) which is capable of retaining fluid when the dispenser adopts an upright orientation. A spider is mounted below the shelf (24) at three equidistant mounting points (27), 120 degrees apart from each of which extends a fixed spokes (28) radially inwardly towards a hub (29) from which three free spokes (30) radiate outwardly, each equidistant between adjacent fixed spokes (28). An annular fluid perturbing bead (31) extends around the interior intermediate between the shelf (24) and mouth (16) of the housing.

The reservoir (5) of the bottle has a closed end (49) and an opposed open end (50) defined by an upper side-wall (32) having an annular interior step (33) dimensioned to receive housing flange (14), the upper surfaces of respectively the reservoir side-wall (32) and the flange (14) being flush. Three channels (34) having a bevelled leading edge (52) 120 degrees apart are moulded in the interior step (33). Each channel (34) is dimensioned to receive the corresponding (lug 17) moulded with the flange (14) of the housing side-wall middle section (8) of housing (3). The step (33) is bevelled downwards (52) beside each channel (34). The interior of the side-wall (32) below step (33) accommodates the lower side-wall (9) of housing (3) and has an internal annular bead (35) that forms a snap-fit fluid-tight seal into groove (21) with bead (22) on the exterior face of the side-wall (9). To its exterior, side-wall (32) has a distinctive groove (48) for decorative purposes.

In a variation to the afore-described dispenser, not separately illustrated, the bottle/housing combination has the annular leak-resistant blade or pair of blades (21*a* or 21*b* in FIG. 8) moulded on the interior face of the bottle between its snap-fit bead (33) and mouth instead of moulded with the housing sidewall (9).

The cap (2) comprises a top wall (36) and a side-wall of circular transverse cross section (37) that fits over housing (3). Top wall (36) has a flat exterior rim (38) which enables the dispenser to stand stably in an invert orientation, and on its underside of which top wall (36) depends centrally an annular wall (39) having a concave base contact surface (40) of similar radius of curvature to that of the ball (4). The cap side-wall (37) has three integrally moulded bayonets (41*a*, 41*b* and 41*c*) positioned at 120 degree intervals. Bayonet (41*a*) is closest to the cap top (36) and furthest from cap mouth (42) and succeeding bayonets (41*b* and 41*c*) are progressively closer to the cap mouth (42). Each bayonet (41) comprises a radially inward-extending blade-shaped boss (43) having rounded radial top edges (49) and a flat base (48) and two axially extending strengthening buttresses (44). On the interior side-wall (37) of the cap (2) located between the bayonets (41) and the top (36) is a multiplicity of equally spaced axially-extending strengthening ribs (45) each having a concave ball-contacting surface (46) of similar radius of curvature to that of the ball (4) dimensioned and located such that when the cap (2) is fitted they exert axial force on the ball (4). To its exterior, cap (2) has a distinctive groove (47) for decorative purposes, centred at an arc of approximately 60° from the centre of bayonet (41*c*) intended in the dispenser design to be matched and aligned with reservoir groove (48).

The dispenser illustrated in FIGS. 1 to 8 is assembled in the following sequence on an assembly line. At a bottle assembly station (not illustrated), the ball housing (3) is positioned above bottle reservoir (5) with its inward end (23) facing reservoir mouth (50) and is axially aligned with the reservoir (5) such that its anti-rotation lugs (17) are in alignment with blind slots (34) moulded into reservoir side-wall (32) and its locating blade (20*a*) of skirt (19) is in alignment with the distinctive groove (48). The housing (3) is then urged axially towards the reservoir (5), its lower wall (9) passing through mouth (50) until the snap fit bead (22) flexes over bead (35) to form a fluid tight connection, lugs (17) slide into blind slots (34) and flange (14) sits on step (33).

The assembled bottle and housing is seated on a puck (not illustrated) that is shaped to retain the bottle in an upright orientation and passed through a filling station (not illustrated) in which a predetermined volume or weight of fluid material (for example 50 mls) is introduced into the reservoir (5), (for example of 60 mls volume) through housing mouth (16). Then, the filled bottle passes to a balling station (not illustrated) in which a ball (4) is urged axially through the mouth (16) until it encounters the sealing shelf (24) and finally passes to a capping station (again not illustrated) in which a cap (2) is centred axially above the bottle (1) with its wall mouth (42) facing the ball (4) and having common axes of cap (2) and housing (3). The cap (2) is urged axially towards the housing (3), bayonets (41) passing between adjacent mounting lugs (10) and rotated about the common axis until each bayonet (41) encounters its matched retaining lug (10) and then each bayonet boss (43) slides across lug cam surface (12) forcing the cap (2) axially towards the housing (3), until it reaches locking recess (13) and boss (43) of bayonet (41*c*) hits stop (15). During rotation of the cap (2) its annular wall (37) and the multiple ribs (45) on its interior bear down on the upper surface of the ball (4) and force it into contact with the concave surface (25) of annular shelf (24) within the housing (3) forming a liquid-tight seal. The filled and capped bottle is released from the puck and drops into a hopper.

In order to open the dispenser, the bottle (1) and cap (2) are grasped in separate hands and the cap is rotated anti-clockwise relative to the bottle, thereby rotating each boss (43) out of retaining recess (13) and when each has rotated beyond leading edge (11) of the retaining lug (10), the cap can be axially removed.

In an alternative embodiment of an invention dispenser, as illustrated in FIGS. 9 and 10, the bottle reservoir and ball housing comprises a single moulding, having the same exterior design with groove (148) as that illustrated in FIGS. 1 to 8 and is capped by the same cap as shown in FIGS. 4, 4*a*, 5, 6, 7 and 7*a* in respect of the first illustrated embodiment. In this alternative design of FIGS. 9 and 10, the bottle is an integrally moulded reservoir and housing comprising an upper housing side-wall (107), a middle housing side-wall (108) which is integral with a reservoir side-wall (105).

The upper wall section (107) is an annular concave truncated hemi-spherical wall which tapers slightly to form a mouth (116) wide enough and the wall being sufficiently flexible to permit the ball (104) to be pressed through. Middle wall (108) has a cylindrical exterior on which are integrally moulded three retaining lugs (110*a*, 110*b*, 110*c*) at 120 degrees apart which form three locking means together with three co-operating bayonets (141*a*, 141*b*, 141*c*) mounted on an interior wall of the cap (102). The retaining lugs (10*a*, 10*b*, 10*c*) are staggered axially, the first mounting lug (10*a*) being closest to mouth (108) and succeeding lugs (10*b*, 10*c*) being progressively further from the mouth (116), such that the cap can be rotated around its common axis with the ball housing (3) until bayonet (141*a*, 141*b*, and 141*c*) respectively) encounters the corresponding lug (110*a*, 110*b*, 110*c*). Each retaining lug (110) comprises a rounded leading edge (111), a cam surface (112) directing a co-operating bayonet (43) away from mouth (116) and a locking recess (113). The third lug (110*c*) is integrally moulded with an exterior circumferential flange (114) providing a stop (115) that prevents continued rotation of the bayonet (141*c*). The flange (114) is integrally moulded with the reservoir side-wall (105).

The interior of the housing (103) is hollow, and approximately spherical truncated at the inward and outward ends of the housing, having an upward facing annular shelf (124) with a concave face (125) of interior diameter sufficiently narrow to prevent passage the ball (104) into the bottle reservoir (151) and distanced from the mouth (116) sufficiently to permit the ball (104) to be rotatable unless depressed onto the shelf concave face (125) by a downward force, such as that exerted by the cap (102) when fitted. The outward edge of the shelf (124) forms with the adjacent side-wall an annular v-shaped groove (126) which is capable of retaining fluid when the dispenser adopts an upright orientation. An annular bead (131) extends around the interior intermediate between the shelf (124) and mouth of the housing (103).

The invention claimed is:

1. A dispenser for a cosmetic fluid comprising a bottle, a cap and a mounting means to enable the cap to be removably mounted on the bottle, said bottle having a first end, and an interior at least partially defined by a reservoir, said first end having an exterior and comprising a housing for a flow regulator that, alone or together with said housing defines a passageway for the fluid from the interior out of the bottle, said cap having a side-wall having an interior surface dimensioned to fit over said bottle first end, and said mounting means comprising a first mounting element and a second mounting element, one element located on the interior surface of the cap being engagable with the other element located on the exterior surface of the bottle by relative rotation of the cap and the bottle about a common axis characterised in that the mounting means comprise a plurality of matched sets of the first element and the second element, in each set the first mounting element comprises a cam surface generating axial movement of cap relative to bottle and the second mounting element comprises a follower, neighbouring first elements having sufficient circumferential lateral separation to allow axial movement of the second element between them and sufficient axial separation to allow rotation of the cap until the first element encounters the second element of the matched set, wherein the first element of each matched set of mounting means is positioned to engage only with the second element with which it is matched and wherein the cap and the bottle have an asymmetric feature.

2. A cosmetic fluid dispenser according to claim 1 in which each second mounting element is positioned symmetrically around the bottle.

3. A cosmetic fluid dispenser according to claim 1 in which three sets of first and second mounting elements are employed.

4. A cosmetic fluid dispenser according to claim 1 in which one mounting element comprises a lug providing the cam surface and the other mounting element comprises a bayonet.

5. A cosmetic fluid dispenser according to claim 4 in which the cam surface of the lug leads to a bayonet-retaining recess.

6. A cosmetic fluid dispenser according to claim 4 in which the fluid flow regulator comprises a roller or ball and the cap exerts an axial force of from 15 to 30 inch pounds on the ball or roller when the bayonet is retained in the recess in the lug.

7. A cosmetic fluid dispenser according to claim 1 in which at least one mounting element has a trailing edge formed into a stop which prevents over-rotation of the cap.

8. A cosmetic fluid dispenser according to claim 1 in which the second mounting element comprises the cam surface.

9. A cosmetic fluid dispenser according to claim 1 in which the second mounting element is located on the exterior of the bottle at or adjacent to the housing.

10. A cosmetic fluid dispenser according to claim 1 in which the cap has a planar exterior or rim permitting the dispenser to stand stably in an invert orientation.

11. A cosmetic fluid dispenser according to claim 1 in which the bottle has a non-flat second end which prevents the dispenser from standing stably in an upright orientation without support.

12. A cosmetic fluid dispenser according to claim 1 in which the fluid flow regulator comprises a roller or ball, and the cap has a wall depending into its interior from its top wall which contacts the roller or ball when the cap is fitted and urges it against the interior of the housing.

13. A cosmetic fluid dispenser according to claim 1 in which the cap side wall comprises an asymmetric feature.

14. A cosmetic fluid dispenser according to claim 1 in which the bottle comprises a reservoir integrally moulded with the housing.

15. A cosmetic fluid dispenser according to claim 1 in which the bottle comprises a housing and a reservoir that are separate mouldings, the housing being mounted on the reservoir.

16. A cosmetic fluid dispenser according to claim 15 in which the housing and reservoir together provide at least one anti-rotation means preventing the housing from rotating relative to the reservoir.

17. A cosmetic fluid dispenser according to claim 16 characterised in that the anti-rotation means comprises an axially-extending lug mounted on a contact surface of one moulding that can be slit into a slot, channel or socket formed in a contact surface of the other moulding.

18. A cosmetic fluid dispenser according to claim 17 characterised in that the lug is mounted on the housing and the slot, channel or socket is formed in the side-wall of the reservoir.

19. A cosmetic fluid dispenser according to claim 17 employing the channel.

20. A cosmetic fluid dispenser according to claim 16 in which the second element for mounting the cap on the bottle is axially aligned with the axially-extending lug.

21. A cosmetic fluid dispenser according to claim 20 in which the second element comprises a lug providing the cam means and the axially-extending lug are both mounted on the housing.

22. A cosmetic fluid dispenser according to claim 16 employing the same number of anti-rotation means as sets of cap-mounting elements.

23. A cosmetic fluid according to claim 15 in which the housing comprises an orientation marker.

24. A cosmetic fluid dispenser according to claim 1 in which the flow regulator is a rotatable ball.

25. A cosmetic fluid dispenser according to claim 24 in which the ball is spherical.

26. A cosmetic fluid dispenser according to claim 1 containing a liquid as the fluid.

27. A cosmetic fluid dispenser according to claim 1 containing an antiperspirant or deodorant composition.

28. A cosmetic dispenser comprising a bottle and a cap removably mountable on the bottle, the bottle being formed by mounting a separately moulded housing for a ball or roller on a separately moulded reservoir, the reservoir having a closed end integral with a side-wall having a neck section defining an aperture, and the housing having an outward end, an inward end and a side-wall extending between the outward and inward ends, said side-wall defining a chamber within which the ball or roller is rotatably retained and having a lower section fitting outside and/or within the neck section of the reservoir, in which the cap is mountable on the housing by a plurality of laterally arranged sets of mounting elements, each set comprising a first mounting element located on the interior surface of the cap that is engagable with a second mounting element located on the exterior surface of the housing by relative rotation of the cap and the housing about a common axis, one of said elements comprising a cam surface generating axial movement of cap relative to housing and the other of said elements comprising a follower, wherein the first element of each matched set of mounting means is positioned to engage only with the second element with which it is matched, and wherein the cap and the bottle have an asymmetric feature.

29. A cosmetic dispenser for a fluid comprising a bottle, a cap and a mounting means to enable the cap to be removably mounted on the bottle, said bottle having a first end, an opposed second end which is profiled to prevent it standing stably in an upright orientation, a side-wall extending from said first end to said second end having an exterior surface, and together with the second end defining an interior, said first end comprising a housing for a flow regulator, said flow regulator alone or together with said housing defining a passageway for the fluid from the interior of the bottle to its exterior when the cap is removed, said cap having a mouth, a top wall, and a side-wall having an interior surface extending from the mouth to the top wall dimensioned to fit over said bottle first end, said top wall having a planar exterior surface or rim permitting the dispenser to stand stably in an invert orientation, and said mounting means comprising a plurality of sets laterally arranged of a first mounting element located on the interior surface of the cap that is engagable with a second mounting element located on the exterior surface of the bottle by relative rotation of the cap and the bottle about a common axis, in each set the first or second mounting element comprising a cam surface generating axial movement of cap relative to bottle and the other mounting element comprising a follower, wherein the first element of each matched set of mounting means is positioned to engage only with the second element with which it is matched, and wherein the cap and the bottle have an asymmetric feature.

* * * * *